United States Patent [19]

Dunn

[11] Patent Number: 5,036,998

[45] Date of Patent: Aug. 6, 1991

[54] TABLE TRASH CONTAINER

[76] Inventor: Ralph C. Dunn, 621 Mehring Way, Ste. 2609, Cincinnati, Ohio 45202

[21] Appl. No.: 427,415

[22] Filed: Oct. 26, 1989

[51] Int. Cl.[5] ..... B65D 25/10

[52] U.S. Cl. ..... 220/469; 220/908

[58] Field of Search ..... 220/1 T, 82 R, 83, 85 H, 220/408, 410, 469, 908; 206/469

[56] References Cited

U.S. PATENT DOCUMENTS

| | | | |
|---|---|---|---|
| 2,213,837 | 9/1940 | Gill | 220/410 |
| 2,895,636 | 7/1959 | Martin | 220/410 X |
| 3,082,901 | 3/1963 | Nakagawa | 220/1 T X |
| 3,445,050 | 5/1969 | Peters et al. | 220/408 |
| 3,498,268 | 3/1970 | Sleith et al. | 220/469 X |
| 3,776,413 | 12/1973 | Myers | 220/408 X |
| 3,804,281 | 4/1974 | Eckdahl | 220/469 X |
| 4,047,633 | 9/1977 | Trombly | 220/469 |
| 4,372,453 | 2/1982 | Branscum | 220/82 R X |
| 4,646,717 | 3/1987 | Baggioli | 220/408 X |
| 4,747,507 | 5/1988 | Fitzgerald et al. | 220/85 H |
| 4,789,073 | 12/1988 | Fine | 220/410 X |

*Primary Examiner*—Steven M. Pollard
*Attorney, Agent, or Firm*—Frost & Jacobs

[57] ABSTRACT

A container for use on a dining table to receive table trash accumulated during a meal. The container has an open top, a bottom and a surrounding transparent outer wall. The container is also provided with an inner wall adjacent the outer wall. The inner wall may constitute an integral one-piece part of the container joined to the outer wall at one of the top and bottom of the container. The inner and outer walls are spaced from each other forming a peripheral space therebetween open at the other of the top and bottom of the container. A sheet-like insert is removably locatable between the inner and outer walls and bears decorative and/or informative indicia visible through the transparent outer wall of the container. The inner wall may constitute the peripheral wall of a removable liner having an open top and a bottom. In this instance, the exterior surface of the liner wall will be provided with decorative and/or informative indicia visible through the transparent outer wall of the container.

7 Claims, 2 Drawing Sheets

TABLE TRASH CONTAINER

TECHNICAL FIELD

The invention relates to a container for use on a dining table to receive table trash accumulated during a meal, and more particularly to such a container provided with a transparent surrounding outer wall and means bearing decorative and/or informative indicia which may be viewed through the transparent outer wall.

BACKGROUND ART

Because of modern trends in marketing and packaging, many food items and condiments are brought to the table in the form of prepackaged, individual servings A non-exhaustive list of such prepackaged items includes sugar, sweetener, salt, pepper, butter, jelly, mayonnaise, mustard, ketchup, tartar sauce, salad dressings, syrup, honey, crackers and the like. Once the contents of the single serving packages has been dispensed, the problem arises as to what to do with the empty, throw-away package.

As a consequence of the above, it is not unusual during the course of a meal in a restaurant or other food-serving establishment to accumulate a considerable amount of such trash. The usual practice is to collect the empty packages on the edge of your plate, on the table adjacent your plate, on a butter plate or in an ashtray (if present). All of these solutions are generally unsatisfactory, annoying and unsightly. A small substantially flat butter plate is not well suited for this purpose. An ashtray is also generally too small, and if filled with paper, plastic or foil packaging, it can no longer be used for its intended purpose.

The present invention is directed to a container intended for and designed for this very purpose. The container has an open top and is of such size as to accommodate the amount of trash accumulated during an average meal. The container is provided with a transparent peripheral outer wall and a bottom. In one embodiment, the container is provided with a peripheral inner wall with a space between the inner and outer wall for the receipt of a sheet-like insert containing decorative and/or informative indicia visible through the transparent outer peripheral wall. In another embodiment, the container is provided with a removable liner having decorative and/or informative indicia printed thereon, again visible through the transparent outer peripheral wall.

In both embodiments, the container can be readily emptied, cleaned and reused, and keeps the dining table free of unsightly wrappings and the like.

DISCLOSURE OF THE INVENTION

In accordance with the invention there is provided a container for use on a dining table to receive table trash accumulated during a meal. The container comprises an open top, a bottom, and a surrounding transparent outer wall. In one embodiment, the container is provided with an inner wall adjacent the outer wall. The inner wall is attached to the outer wall by a web at one of the top and bottom of the container. The inner and outer walls are spaced, forming a peripheral opening therebetween at the other of the top and bottom of the container. A sheet-like insert is removably and replaceably located between the inner and outer walls and is provided with decorative and/or informative indicia visible through the transparent outer wall.

In another embodiment of the invention, the container comprises a transparent peripheral wall, a bottom, and an open top. The container is adapted to receive a correspondingly shaped inner liner having a peripheral wall, a bottom and an open top. The liner bottom abuts the bottom of the container, or the liner is suspended within the container by means of a peripheral flange at the upper end of the liner engaging a peripheral groove in the upper end of the container wall. In this embodiment, the outer wall of the liner is provided with decorative and/or informative indicia, visible through the transparent wall of the container.

Both embodiments of the container lend themselves well to be fabricated of plastic, or molded of plastic.

DETAILED DESCRIPTION OF THE INVENTION

Figure 1:
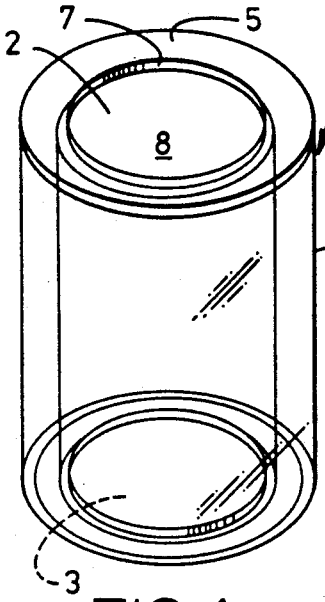
FIG. 1 is a perspective view of one embodiment of the present invention.
Figure 2:
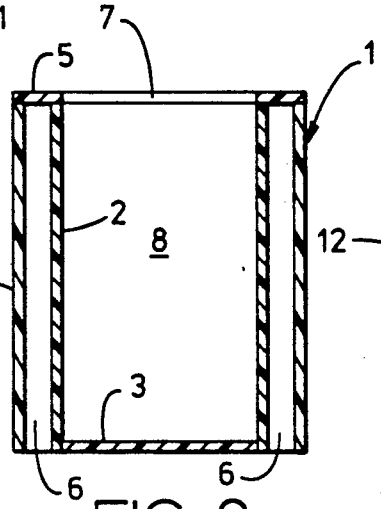
FIG. 2 is a cross-sectional elevational view of the embodiment of FIG. 1.

A simple embodiment of the present invention is illustrated in FIGS. 1 and 2. The table trash container is generally indicated at 1, and in this embodiment the container is fabricated of four plastic parts assembled with appropriate adhesive material to form a unitary structure. The four parts consist of a cylindrical inner wall 2, a circular bottom 3, a cylindrical outer wall 4 of slightly larger diameter than the inner wall 2 and an annular ring-like web 5 which is glued to the upper ends of inner wall 2 and outer wall 4, joining them together. The inner wall 2, outer wall 4 and annular web 5 define an annular space 6 therebetween. As will be explained hereinafter, the annular space 6 is adapted to receive a sheet-like insert bearing decorative and/or informative indicia. It will be noted from FIGS. 1 and 2 that the inner surface of annular web 5 defines an open top 7 for the container. The inner wall 2 and bottom 3 define a chamber 8 for the receipt of table trash such as paper, foil or plastic wrappings and the like. The chamber 8 may also be used for the deposit of food scraps, bones and the like, if desired.

Figure 3:
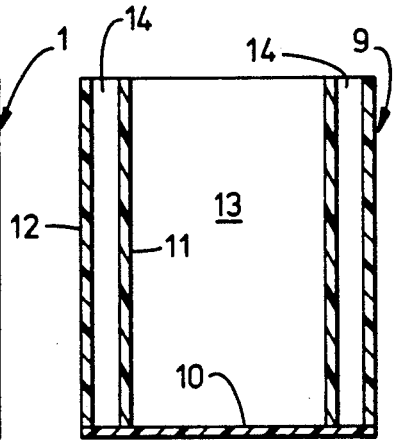
FIG. 3 is a cross-sectional elevational view, similar to FIG. 2, but illustrating the opening between the inner and outer walls at the top of the vessel.

FIG. 3 illustrates a modified embodiment of the table trash container, which is generally indicated at 9. In this embodiment, the container 9 comprises a circular bottom 10 to which an inner cylindrical wall 11 and an outer cylindrical wall 12 are affixed by an appropriate glue. The upper end of cylindrical wall 11 defines an open upper end for the container and the cylindrical inner wall 11 and bottom 10 define a chamber 13 equivalent to chamber 8 of FIGS. 1 and 2. Furthermore, the cylindrical inner wall 11 and the cylindrical outer wall 12, together with bottom 10, define an annular space 14 equivalent to the annular space 6 of the embodiment of FIGS. 1 and 2. In this instance, however, the annular space 14 is open at the upper end of container 9, while the annular space 6 is open at the lower end of container 1.

Figure 6:
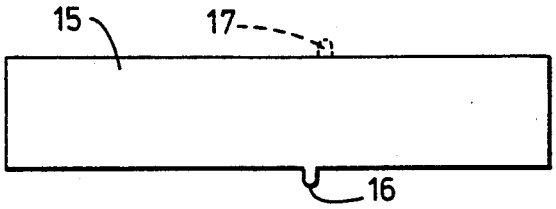
FIG. 6 is an elevational view of a sheet-like insert adapted to be removably and replaceably mounted between the inner and outer walls of the embodiments of FIGS. 1 through 5.

As indicated above, the annular space 6 of container 1 and the annular space 14 of container 9 are adapted to receive a removable and replaceable sheet-like insert of the type illustrated at 15 in FIG. 6. The sheet-like insert 15 will have a width approximating the vertical dimension of the annular space 6 of container 1 or the annular space 14 of container 9. The sheet-like insert 15 will have a length at least equal to the circumferential dimension of the inside surface of outer wall 4 of container 1 or outer wall 12 of container 9. The sheet-like insert 15 is preferably made of paper, thin paper board or the like. When it is applied to the vessel 1 of FIGS. 1 and 2, ends of the sheet-like member 15 are brought together to form a cylindrical structure, and this cylindrical structure is inserted in the annular space 6 between inner and outer walls 2 and 4. Once in place, the sheet-like insert 15 will tend to expand against the inside surface of outer wall 4 and will normally be held in place by friction.

The sheet-like insert 15 may be removed from the annular space 6 of container 1 for purposes of replacement with a new insert, or to enable overall cleaning of the container 1. Removal of insert 15 may be facilitated by providing the insert with a downwardly depending tab 16 on its lower edge, as viewed in FIG. 6. By simply grasping the tab and pulling it downwardly, the insert can be removed. While the insert 15 is in place within the annular space 6 of container 1, the tab 16 can simply fold inwardly along the outside surface of bottom 3.

The insert 15 may be used in precisely the same manner in the embodiment of FIG. 3. In this instance, the tab 16 may be replaced by a similar tab 17 (shown in FIG. 6 in broken lines) extending upwardly from the upper edge of insert 15. When the insert 15 is applied to the container 9 of FIG. 3, it is again formed into a cylindrical shape and introduced into the annular space 14 from the upper end of container 9.

While both embodiments 1 and 9 of the container serve their purpose well, it will be understood that the embodiment 1 of FIGS. 1 and 2 is preferred since in this embodiment, it would be impossible for table trash to enter the annular space 6 which is open at the bottom of vessel 1.

With respect to the embodiments 1 and 9 of FIGS. 1-3, the outer walls 4 and 12 are formed of clear plastic material. Any appropriate clear thermoplastic or thermosetting material can be used inclusive of, but not limited to, acrylic, polycarbonate, polyarylsulfane, vinyl, epoxy, and the like. It is within the scope of the invention to form the container of glass if desired. The outer walls 4 and 12 may be color-tinted.

The remaining parts of containers 1 and 9 may be made of the same transparent plastic material as exterior walls 4 and 12, or they may be made of opaque plastic material such as ABS, or the like.

Figure 4:
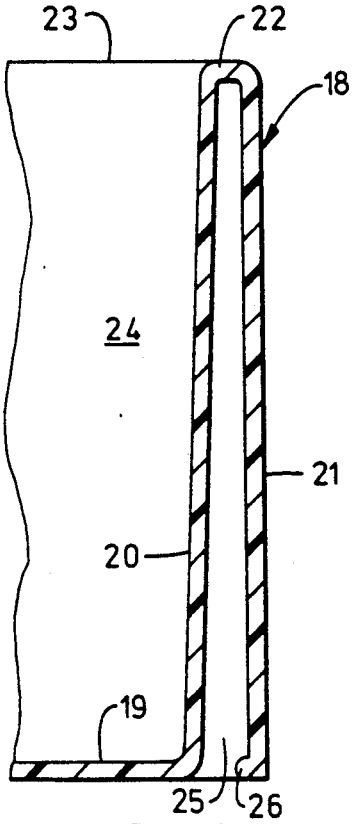
FIG. 4 is a fragmentary, cross-sectional, elevational view of a preferred embodiment wherein the container comprises an integral, one-piece, molded unit, the exterior wall being vertical and the interior wall sloping slightly downwardly and inwardly.
Figure 4A:
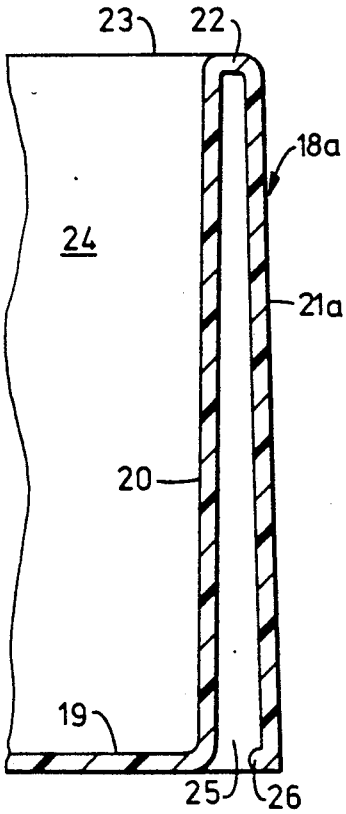
FIG. 4*a* is a fragmentary, cross-sectional, elevational view, similar to FIG. 4, illustrating an integral, one-piece molded container wherein the exterior wall slopes slightly downwardly and outwardly and the interior wall slopes slightly downwardly and inwardly.
Figure 5:
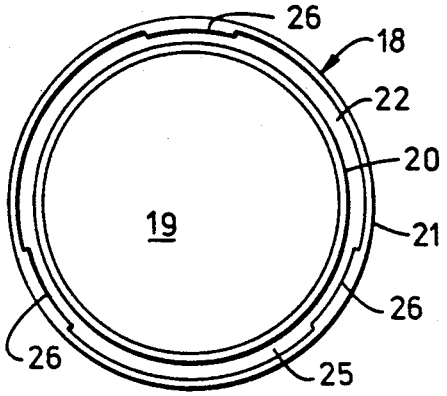
FIG. 5 is a bottom view of the embodiment of FIG. 4.

FIGS. 4 and 4A illustrate preferred embodiments of the table trash container of the present invention. Turning first to FIG. 4, there is fragmentarily illustrated a container (generally indicated at 18) which is similar to the embodiment of FIGS. 1 and 2, but comprises an integral, one-piece, molded structure. The container 18 lends itself well to injection molding, and again may be made of any appropriate clear thermoplastic material such as those listed above. The container 18 comprises a bottom 19, an inner wall 20, an outer wall 21 and an annular web 22 joining the upper ends of inner wall 20 and outer wall 21. Container 18 has an open upper end 23, and the bottom 19 and the inner wall 20 define a chamber 24 equivalent to chamber 8 of FIGS. 1 and 2 and chamber 13 of FIG. 3. The inner wall 20, the outer wall 21 and the connecting web 22 define an annular space 25 equivalent to the annular space 6 of FIGS. 1 and 2 and intended to serve the same purpose. To this end, an insert of the type shown at 15 in FIG. 6 can be introduced into the annular space 25 at the bottom of the container. The natural tendency of the insert 15 to expand will cause it to lie adjacent outside wall 21. It is within the scope of the present invention to provide a series of narrow inwardly extending lugs 6 on the inside surface of outside wall 21 at the lower end thereof, which will prevent unintentional dislodgement of the insert 15. Reference is made to FIG. 5 which is a bottom view of the embodiment of FIG. 4. In FIG. 5, the container is provided with three such inturned lugs 26, evenly spaced thereabout.

Since the preferred embodiment of FIG. 4 is an integral, one-piece, molded unit, it is desirable for molding purposes to cause either the inside wall 20 to slope downwardly and inwardly, or the outside wall 21 to slope downwardly and outwardly, or both In the preferred embodiment of FIG. 4, the outside wall 21 is vertical and the inside wall 20 slopes downwardly and inwardly at an angle of from about ½° to 1° from the vertical. FIG. 4A illustrates an embodiment **18*a* substantially identical to that of FIG. 4, and like parts have been given like index numerals. In FIG. 4A, the inside wall 20 also slopes downwardly and inwardly, forming an angle with the vertical of from about ½° to about 1°. The difference between the embodiment of FIG. 4A and FIG. 4 lies in the fact that the outside wall 21*a* also slopes downwardly and outwardly, forming an angle to the vertical of about ½° to about 1°. Therefore, the inside wall 20 and the outside wall 21*a*** form between them an angle of from about 1° to about 2°.

Figure 7:
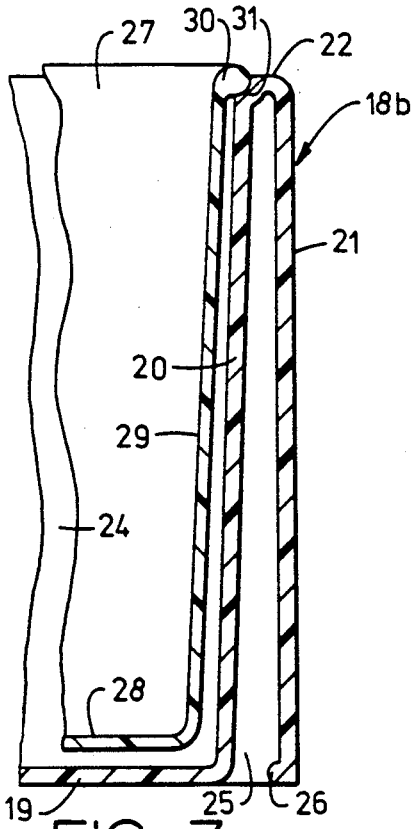
FIG. 7 is a fragmentary, cross-sectional, elevational view, similar to FIG. 4, and illustrating an integral, one-piece, molded container provided with a removable liner.

It is within the scope of the invention to provide the embodiments of the container thus far described with a removable liner which is either reusable or disposable. In such an instance, it is the liner which actually receives the table trash. The liner may be a cup-like structure made of paper or foamed or non-foamed plastic. In fact, the container may be so sized as to accept a standard size plastic, styrofoam or waxed paper cup as a liner. In FIG. 7, an embodiment similar to that of FIG.

4 is illustrated provided with such a liner. With respect to the container 18*b*, those parts similar to the parts of container 18 of FIG. 4 have been given like index numerals. The liner is indicated at 27. The liner comprises a bottom 28 and a peripheral wall 29. The liner 27 may be so sized that it bottoms in container 18*b* with its bottom 28 abutting the container bottom 19. Alternatively, the liner 27 may be provided with a peripheral outwardly extending lip or flange 30 at its open upper end. The lip or flange 30 may be received in an annular notch 31 formed in the upper end of inner wall 20. Where the liner 27 is slightly shorter than the container 18*b* (as shown in FIG. 7), the liner 27 will be suspended within the chamber 24 of container 18*b* by the engagement of lip 30 in notch 31. If the liner 27 is of such length that it will bottom within chamber 24, engagement of lip 30 within notch 31 will tend to form a seal between the liner 27 and the inner wall 20, assuring that all of the table trash introduced into the structure will enter the liner 27 and not the container chamber 24.

The container 18*b* of FIG. 7 is adapted to receive an insert of the type shown at 15 in FIG. 6, as taught with respect to the previously described container embodiments.

Since the container 18*b* of FIG. 7 is molded of clear plastic material, both the inside wall 20 and the outside wall 21 are transparent. In the absence of an insert of the type shown in FIG. 6, it would be within the scope of the invention to provide the exterior surface of liner 27 with decorative and/or informative indicia visible through both walls 20 and 21. With respect to the embodiments of FIGS. 4 and 4A, the inside surface of inner wall 20 may be provided with a mat finish so that the collected table trash would not be visible through the walls of containers 18 and 18*a*, in the absence of an insert 15. It would also be within the scope of the invention to apply a pattern or indicia to outer wall 21 by etching or other appropriate means.

The dimensions of the containers thus far described do not constitute a limitation of the invention. For purposes of an exemplary showing, excellent results have been achieved with a container having an outside diameter of about 4½" and a vertical height of about 5½". With such a unit, an insert 5⅜" wide and 13⅜" long was used.

Figure 8:
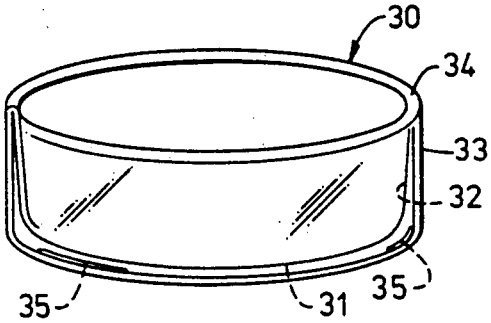
FIG. 8 is a perspective view of an integral, one-piece, molded container similar to that of FIG. 4, but of lesser height and greater diameter.

Although all of the previously described containers were of a height greater than their outside diameters, this need not necessarily be the case. A container having a height less than its outside diameter is generally indicated at 30 in FIG. 8. With the exception of dimensions of height and diameter, the container 30 may be otherwise identical in construction to any one of the embodiments of FIGS. 4, 4A, and 7. For purposes of an exemplary showing, it is illustrated as being identical in construction to the embodiment of FIG. 4, having a bottom 31 equivalent to the bottom 19, inner and outer walls 32 and 33 equivalent to inner and outer walls 20 and 21 connected by a web 34 similar to web 22. The container 30 is intended to be provided with an insert of the type illustrated at 15 in FIG. 6. To this end, the outside wall 33 is provided with a series of inwardly extending flanges 35 evenly spaced thereabout and equivalent to the flanges 26 of FIG. 4. While the container 30 lends itself well to a table trash container, by virtue of its shape it could also be used as a receptacle for snack foods such as potato chips, popcorn, pretzels or the like.

Figure 9:
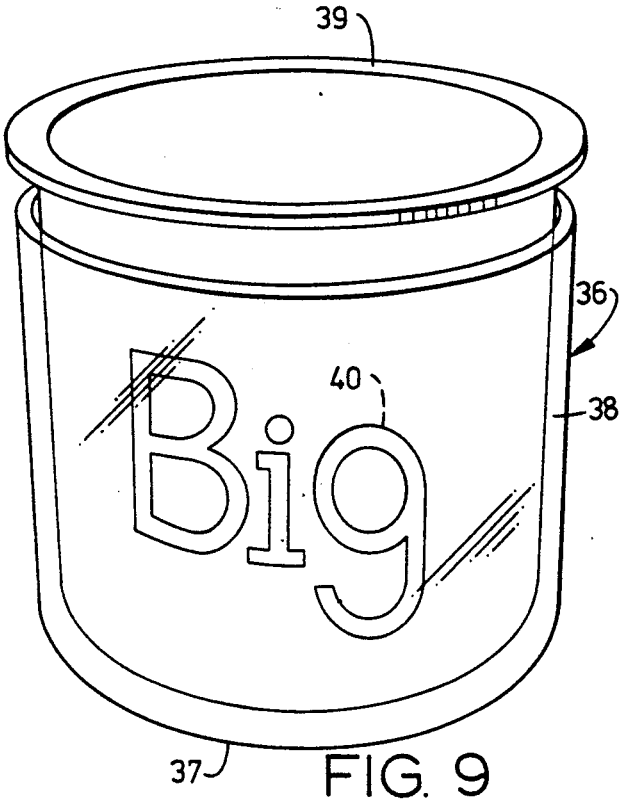
FIG. 9 is a perspective view of another embodiment of the present invention, provided with a removable liner.

A final embodiment of the container of the present invention is illustrated in FIG. 9. In this instance, the container (generally indicated at 36) is fabricated or molded of clear plastic material and comprises a bottom 37 and a single surrounding wall 38. The container 36 is adapted to receive a reusable or disposable liner 39. The liner may be made of any apPropriate material such as paper, waxed paper, plastic or styrofoam. The liner should have a shape generally corresponding to that of the container 36.

The liner 39 may be of the type described in FIG. 7 at 27 and the inside upper surface of wall 38 may be provided with an annular groove similar to groove 31 of FIG. 7. On the other hand, as shown, the liner 39 may simply bottom in container 38. In either instance, the exterior surface of the liner is provided with decorative and/or informative indicia as is shown at 40. At the end of a meal, the liner 39 is removed from the container 36 and is emptied, cleaned and replaced in container 36. Alternatively, if the liner is intended to be a disposable liner, it is simply removed from the container and disposed of, with a new liner mounted in the container for subsequent use.

In all of the above described embodiments, the container is substantially cylindrical in configuration. While this is a preferred configuration, it is nonetheless nonlimiting. Any of the above described embodiments could be made with three or more planar single or double walled sides, as would be apparent to one skilled in the art.

In all of the embodiments, the indicia on the liner or on the insert 15 can be strictly decorative, strictly informative, or both. The indicia may constitute an advertisement for the establishment using the table trash container or for a specialty meal of the establishment. Where the table trash container is used in nursing homes, retirement homes or the like, the insert could be imprinted with a calendar of events for a given day, week or month. There is no limitation on the nature of the indicia carried by the insert 15 or the exterior surface of the liner. The insert 15 or liner can be changed on a daily or weekly basis.

Modifications may be made in the invention without departing from the spirit of it.

What is claimed is:

1. A container for use on a dining table to receive table trash accumulated during a meal, said container comprising an open top, a bottom, an upstanding surrounding outer wall and an upstanding inner wall corresponding to said outer wall and spaced inwardly thereof, said outer wall being transparent and having an inner surface and an outer surface, said inner wall having an inner surface and an outer surface, said inner wall being attached to said vessel bottom, said inner and outer walls being joined together by an annular web at said top of said container, said inner and outer walls and said web defining a surrounding space open to the exterior of said vessel at said vessel bottom, a sheet-like insert removably and replaceably locatable within said surrounding space defined by said inner and outer walls and said annular web, said insert having a surface facing said inner surface of said outer wall, said insert surface having at least one of decorative and informative indicia thereon viewable through said transparent outer wall, said insert being insertable in and removable from said surrounding space without disassembly of said container, and a plurality of inwardly extending lugs formed on said inside surface of said outer wall adjacent the bottom edge thereof and evenly spaced thereabout to support said insert within said surrounding space defined by said inner and outer walls and said annular web.

2. The container claimed in claim 1 comprising an integral, one-piece structure molded of transparent material.

3. The container claimed in claim 1 wherein said container inner and outer walls are substantially cylindrical.

4. The container claimed in claim 1 wherein said inner and outer walls are made up of the same number of planar panels, said number being at least 3.

5. The container claimed in claim 1 including a tab on said insert facilitating its removal from said surrounding space defined by said inner and outer walls and said annular web.

6. The container claimed in claim 1 including a removable liner for said container, said liner having a bottom, a surrounding wall and a open top, said liner being removably receivable within the confines of said container bottom and inner wall.

7. The container claimed in claim 6 including an annular groove formed in said inner wall at said open top of said container, said liner having an outwardly extending annular lip on its surrounding wall at the open top of said liner, said liner lip being received in said container groove when said liner is mounted in said container.

* * * * *